US012408701B2

(12) United States Patent
Boham et al.

(10) Patent No.: US 12,408,701 B2
(45) Date of Patent: Sep. 9, 2025

(54) ELECTRODE ASSEMBLY FOR AN AEROSOLE PROVISION SYSTEM AND CORRESPONDING METHOD

(71) Applicant: Nicoventures Trading Limited, London (GB)

(72) Inventors: Scott George Boham, London (GB); Paul Gibson, London (GB)

(73) Assignee: Nicoventures Trading Limited, London (GB)

( * ) Notice: Subject to any disclaimer, the term of this patent is extended or adjusted under 35 U.S.C. 154(b) by 692 days.

(21) Appl. No.: 17/439,792

(22) PCT Filed: Mar. 13, 2020

(86) PCT No.: PCT/GB2020/050650
§ 371 (c)(1),
(2) Date: Sep. 15, 2021

(87) PCT Pub. No.: WO2020/188257
PCT Pub. Date: Sep. 24, 2020

(65) Prior Publication Data

US 2022/0125111 A1 Apr. 28, 2022

(30) Foreign Application Priority Data

Mar. 15, 2019 (GB) ..... 1903563

(51) Int. Cl.
*A24F 40/46* (2020.01)
*A24F 40/44* (2020.01)

(52) U.S. Cl.
CPC ..... *A24F 40/46* (2020.01); *A24F 40/44* (2020.01)

(58) Field of Classification Search
CPC ..... A24F 40/16; A24F 40/42
(Continued)

(56) References Cited

U.S. PATENT DOCUMENTS 3,781,986 A 1/1974 Joslyn et al.
2013/0192617 A1 8/2013 Thompson
(Continued)

FOREIGN PATENT DOCUMENTS

CN 109007980 A 12/2018
DE 102015214757 * 3/2017 ..... H01R 33/06
DE 102015214757 A1 3/2017

OTHER PUBLICATIONS

"International Preliminary Report on Patentability for Application No. PCT/GB2020/050650, mailed on Sep. 30, 2021", 08 pages.
(Continued)

*Primary Examiner* — Manley L Cummins, IV
(74) *Attorney, Agent, or Firm* — Merchant & Gould P.C.

(57) ABSTRACT

An assembly comprising a body (50) defining an aperture (52), and an electrode (10) comprising a portion (54) within the aperture (52), the assembly further comprising a lead (12) comprising a section (56) which is secured inside the aperture (52) by a first interference fit between the body (50) and the portion (54) of the electrode (10). The aperture (52) may comprise a first open end (58) and a second open end (60), wherein the electrode (10) extends through the first open end (58), and the lead (12) extends through the second open end (60). In which case, the electrode (10) may plug the first end (58) by a second interference fit between the body (50) and the (portion (54) of the electrode (10). The portion (54) of the electrode (12) may comprise a tapered section (62) against which the section (56) of the lead (12) is secured.

19 Claims, 4 Drawing Sheets

4) Remove heat and force and cool assembly

(58) Field of Classification Search
USPC ..... 131/271, 328, 329
See application file for complete search history.

(56) References Cited

U.S. PATENT DOCUMENTS

| | | | | |
|---|---|---|---|---|
| 2014/0144453 | A1 | 5/2014 | Capuano et al. | |
| 2014/0332019 | A1* | 11/2014 | Liu | A24F 40/50 392/404 |
| 2015/0013701 | A1* | 1/2015 | Liu | A24F 40/40 131/329 |
| 2016/0135503 | A1 | 5/2016 | Liu | |
| 2016/0135505 | A1 | 5/2016 | Li et al. | |
| 2016/0143365 | A1 | 5/2016 | Liu | |
| 2016/0192710 | A1* | 7/2016 | Liu | A24F 40/44 131/329 |
| 2017/0105453 | A1 | 4/2017 | Li et al. | |
| 2017/0340011 | A1 | 11/2017 | Batista | |
| 2020/0085108 | A1* | 3/2020 | Li | A24F 40/10 |

OTHER PUBLICATIONS

"International Search Report and Written Opinion received for PCT Patent Application No. PCT/GB2020/050650, mailed on Apr. 30, 2020", 12 pages.

* cited by examiner

1) Insert wire to hole

2) Apply force to pin

3) Apply heat to wire (optional)

4) Remove heat and force and cool assembly

ELECTRODE ASSEMBLY FOR AN AEROSOLE PROVISION SYSTEM AND CORRESPONDING METHOD

CROSS-REFERENCE TO RELATED APPLICATIONS

This application is a National Phase entry of PCT Application No. PCT/GB2020/050650, filed Mar. 13, 2020, which application claims the benefit of priority to GB Application No. 1903563.5, filed Mar. 15, 2019, the entire disclosures of which are incorporated herein by reference.

FIELD

The present disclosure relates to an electrode assembly, and corresponding method. The electrode assembly is suited for use in an aerosol provision systems such as, but not limited to, nicotine delivery systems (e.g. electronic cigarettes and the like).

BACKGROUND

Electronic aerosol provision systems such as electronic cigarettes (e-cigarettes) generally contain an aerosol precursor material, such as a reservoir of a source liquid containing a formulation, typically but not necessarily including nicotine, or a solid material such a tobacco-based product, from which an aerosol is generated for inhalation by a user, for example through heat vaporisation. Thus, an aerosol provision system will typically comprise a heating element, e.g., a heating element, arranged to vaporise a portion of precursor material to generate an aerosol in an aerosol generation region of an air channel through the aerosol provision system. As a user inhales on the device and electrical power is supplied to the heating element, air is drawn into the device through one or more inlet holes and along the air channel to the aerosol generation region, where the air mixes with the vaporised precursor material and forms a condensation aerosol. The air drawn through the aerosol generation region continues along the air channel to a mouthpiece opening, carrying some of the aerosol with it, and out through the mouthpiece opening for inhalation by the user.

It is common for aerosol provision systems to comprise a modular assembly, often having two main functional parts, namely a control unit and disposable/replaceable cartridge part. Typically, the cartridge part will comprise the consumable aerosol precursor material and the heating element (atomiser), while the control unit part will comprise longer-life items, such as a rechargeable battery, device control circuitry, activation sensors and user interface features. The control unit may also be referred to as a reusable part or battery section and the replaceable cartridge may also be referred to as a disposable part or cartomizer.

The control unit and cartridge are mechanically coupled together at an interface for use, for example using a screw thread, bayonet, latched or friction fit fixing. When the aerosol precursor material in a cartridge has been exhausted, or the user wishes to switch to a different cartridge having a different aerosol precursor material, the cartridge may be removed from the control unit and a replacement cartridge may be attached to the device in its place.

Electrical contacts/electrodes are provided on each of the control unit and cartridge for transferring power between the two components. In the case of each electrode on the cartridge, a lead is employed to transfer power from the electrode to the heating element in the cartridge.

A potential drawback in such cartridges is that the lead may become detached from the electrode during use, causing unwanted short-circuits and faulty operation of the cartridge. A potential further drawback for such cartridges, which typically contain liquid aerosol precursor (e-liquid) is the risk of leakage. An e-cigarette cartridge will typically have a mechanism, e.g., a capillary wick, for drawing liquid from a liquid reservoir to a heating element located in an air path / channel connecting from an air inlet to an aerosol outlet for the cartridge. Because there is a fluid transport path from the liquid reservoir into the open air channel through the cartridge, there is a corresponding risk of liquid leaking from the cartridge. Leakage is undesirable both from the perspective of the end user naturally not wanting to get the e-liquid on their hands or other items.

Various approaches are described herein which seek to help address or mitigate some of the issues discussed above.

SUMMARY

According to a first aspect of certain embodiments there is provided an assembly comprising a body defining an aperture, and an electrode comprising a portion within the aperture, the assembly further comprising a lead comprising a section which is secured inside the aperture by a first interference fit between the body and the portion of the electrode.

According to a second aspect of certain embodiments there is provided a cartridge for an aerosol provision system, wherein the cartridge comprises the assembly according to the first aspect, wherein the heating element is located in an aerosol generation region from the cartridge, and is for heating aerosolizable material from a reservoir to generate aerosol in the aerosol generation region, wherein the cartridge further comprises an air channel extending through the cartridge for delivering air to the heating element.

According to a third aspect of certain embodiments there is provided a method of connecting a body defining an aperture; an electrode; and a lead comprising a section which is configured to be secured inside the aperture, wherein the method comprises:

inserting the section of the lead into the aperture; and inserting the portion of the electrode into the aperture such to secure the section of the lead inside the aperture between the body and the portion of the electrode by a first interference fit.

According to a fourth aspect of certain embodiments there is provided an assembly according to the first aspect or the cartridge according to the second aspect, wherein the section of the lead is secured inside the aperture using the method according to the third aspect.

It will be appreciated that features and aspects of the disclosure described above in relation to the various aspects of the invention are equally applicable to, and may be combined with, embodiments according to other aspects of the disclosure as appropriate, and not just in the specific combinations described herein.

BRIEF DESCRIPTION OF THE DRAWINGS

Embodiments of the disclosure will now be described, by way of example only, with reference to the accompanying drawings, in which.

DETAILED DESCRIPTION

Figure 1:
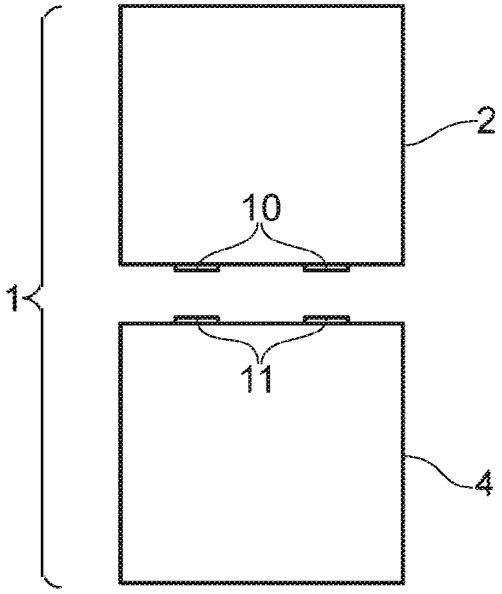
FIG. 1 schematically represents an aerosol provision system comprising a cartridge and a control unit.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to non-combustible aerosol provision systems, which may also be referred to as aerosol provision systems, such as e-cigarettes. According to the present disclosure, a "non-combustible" aerosol provision system is one where a constituent aerosolizable material of the aerosol provision system (or component thereof) is not combusted or burned in order to facilitate delivery to a user. Aerosolizable material, which also may be referred to herein as aerosol generating material or aerosol precursor material, is material that is capable of generating aerosol, for example when heated, irradiated or energized in any other way.

Throughout the following description the term "e-cigarette" or "electronic cigarette" may sometimes be used, but it will be appreciated this term may be used interchangeably with aerosol provision system/device and electronic aerosol provision system/device. An electronic cigarette may also known as a vaping device or electronic nicotine delivery system (END), although it is noted that the presence of nicotine in the aerosolizable material is not a requirement.

In some embodiments, the non-combustible aerosol provision system is a hybrid system to generate aerosol using a combination of aerosolizable materials, one or a plurality of which may be heated. In some embodiments, the hybrid system comprises a liquid or gel aerosolizable material and a solid aerosolizable material. The solid aerosolizable material may comprise, for example, tobacco or a non-tobacco product.

Typically, the non-combustible aerosol provision system may comprise a non-combustible aerosol provision device and an article for use with the non-combustible aerosol provision device. However, it is envisaged that articles which themselves comprise a means for powering an aerosol generating component may themselves form the non-combustible aerosol provision system.

In some embodiments, the article for use with the non-combustible aerosol provision device may comprise an aerosolizable material (or aerosol precursor material), an aerosol generating component (or vaporiser), an aerosol generating area, a mouthpiece, or an area for receiving aerosolizable material.

In some embodiments, the aerosol generating component is a heater capable of interacting with the aerosolizable material so as to release one or more volatiles from the aerosolizable material to form an aerosol. In some embodiments, the aerosol generating component is capable of generating an aerosol from the aerosolizable material without heating. For example, the aerosol generating component may be capable of generating an aerosol from the aerosolizable material without applying heat thereto, for example via one or more of vibrational, mechanical, pressurisation or electrostatic means.

In some embodiments, the substance to be delivered may be an aerosolizable material which may comprise an active constituent, a carrier constituent and optionally one or more other functional constituents.

The active constituent may comprise one or more physiologically or olfactory active constituents which are included in the aerosolizable material in order to achieve a physiological or olfactory response in the user. The active constituent may for example be selected from nutraceuticals, nootropics, and psychoactives. The active constituent may be naturally occurring or synthetically obtained. The active constituent may comprise for example nicotine, caffeine, taurine, theine, a vitamin such as B6 or B12 or C, melatonin, a cannabinoid, or a constituent, derivative, or combinations thereof. The active constituent may comprise a constituent, derivative or extract of tobacco or of another botanical. In some embodiments, the active constituent is a physiologically active constituent and may be selected from nicotine, nicotine salts (e.g., nicotine ditartrate/nicotine bitartrate), nicotine-free tobacco substitutes, other alkaloids such as caffeine, or mixtures thereof.

In some embodiments, the active constituent is an olfactory active constituent and may be selected from a "flavor" or "flavorant" which, where local regulations permit, may be used to create a desired taste, aroma or other somatosensorial sensation in a product for adult consumers. In some instances such constituents may be referred to as flavors, flavorants, cooling agents, heating agents, or sweetening agents. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, ginkgo biloba, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gasone or more of extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the flavor comprises menthol, spearmint or peppermint. In some embodiments, the flavor comprises flavor components of cucumber, blueberry, citrus fruits or redberry. In some embodiments, the flavor comprises eugenol. In some embodiments, the flavor comprises flavor components extracted from tobacco. In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

The carrier constituent may comprise one or more constituents capable of forming an aerosol. In some embodiments, the carrier constituent may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional constituents may comprise one or more of pH regulators, colouring agents, preservatives, binders, fillers, stabilizers, or antioxidants.

As noted above, aerosol provision systems (e-cigarettes) often comprise a modular assembly including both a reusable part (control unit) and a replaceable (disposable) cartridge part. Devices conforming to this type of two-part modular configuration may generally be referred to as two-part devices. It is also common for electronic cigarettes to have a generally elongate shape. For the sake of providing a concrete example, certain embodiments of the disclosure described herein comprise this kind of generally elongate two-part device employing disposable cartridges. However, it will be appreciated the underlying principles described herein may equally be adopted for other electronic cigarette configurations, for example modular devices comprising more than two parts, as devices conforming to other overall shapes, for example based on so-called box-mod high performance devices that typically have a more boxy shape.

FIG. 1 is a schematic perspective view of an example aerosol provision system/device (e-cigarette) 1 in accordance with certain embodiments of the disclosure. Terms concerning the relative location of various aspects of the electronic cigarette (e.g., terms such as upper, lower, above, below, top, bottom etc.) are used herein with reference to the orientation of the electronic cigarette as shown in FIG. 1 (unless the context indicates otherwise). However, it will be appreciated this is purely for ease of explanation and is not intended to indicate there is any required orientation for the electronic cigarette in use.

The e-cigarette 1 comprises two main components, namely a cartridge 2 and a control unit 4. The control unit 4 and the cartridge 2 are coupled together when in use.

The cartridge 2 and control unit 4 are coupled by establishing a mechanical and electrical connection between them. The specific manner in which the mechanical and electrical connection is established is not of primary significance to the principles described herein and may be established in accordance with conventional techniques, for example based around a screw thread, bayonet, latched or friction-fit mechanical fixing with appropriately arranged electrical contacts/electrodes for establishing the electrical connection between the two parts as appropriate. For example, in the case of the cartridge 2 shown in FIG. 1, this cartridge 2 comprises a mouthpiece end 6 and an interface end 8. The cartridge 2 is coupled to the control unit 4 by a coupling arrangement (not shown in the FIGS.) at the interface end 8 of the cartridge 2 such to provide a releasable mechanical engagement between the cartridge and the control unit. An electrical connection is established between the control unit and the cartridge via a pair of electrical contacts/electrodes 10 on the bottom of the cartridge 2 and corresponding contact pins/electrodes 11 in the control unit 4. As noted above, the specific manner in which the electrical connection is established is not significant to the principles described herein.

It will be appreciated the specific size and shape of the electronic cigarette and the material from which it is made is not of primary significance to the principles described herein and may be different in different implementations. That is to say, the principles described herein may equally be adopted for electronic cigarettes having different sizes, shapes and/or materials.

The control unit 4 may in accordance with certain embodiments of the disclosure be broadly conventional in terms of its functionality and general construction techniques. In some embodiments, the control unit may comprise a plastic outer housing including a receptacle wall that defines a receptacle for receiving the interface end 10 of the cartridge 2.

The control unit 4 further comprises a battery for providing operating power for the electronic cigarette 1, control circuitry for controlling and monitoring the operation of the electronic cigarette, a user input button, and a charging port.

The battery in some embodiments may be rechargeable and may be of a conventional type, for example of the kind normally used in electronic cigarettes and other applications requiring provision of relatively high currents over relatively short periods. The battery may be recharged through the charging port, which may, for example, comprise a USB connector.

The input button may be considered an input device for detecting user input, e.g., to trigger aerosol generation, and the specific manner in which the button is implemented is not significant. For example, other forms of mechanical button or touch-sensitive button (e.g., based on capacitive or optical sensing techniques) may be used in other implementations, or there may be no button and the device may rely on a puff detector for triggering aerosol generation.

The control circuitry is suitably configured/programmed to control the operation of the electronic cigarette to provide conventional operating functions in line with the established techniques for controlling electronic cigarettes. The control circuitry (processor circuitry) may be considered to logically comprise various sub-units/circuitry elements associated with different aspects of the electronic cigarette's operation. For example, depending on the functionality provided in different implementations, the control circuitry may comprises power supply control circuitry for controlling the supply of power from the battery to the cartridge in response to user input, user programming circuitry for establishing configuration settings (e.g. user-defined power settings) in response to user input, as well as other functional units/circuitry associated functionality in accordance with the principles described herein and conventional operating aspects of electronic cigarettes. It will be appreciated the functionality of the control circuitry can be provided in various different ways, for example using one or more suitably programmed programmable computer(s) and/or one or more suitably configured application-specific integrated circuit(s)/circuitry/chip(s)/chipset(s) configured to provide the desired functionality.

Figure 2B:
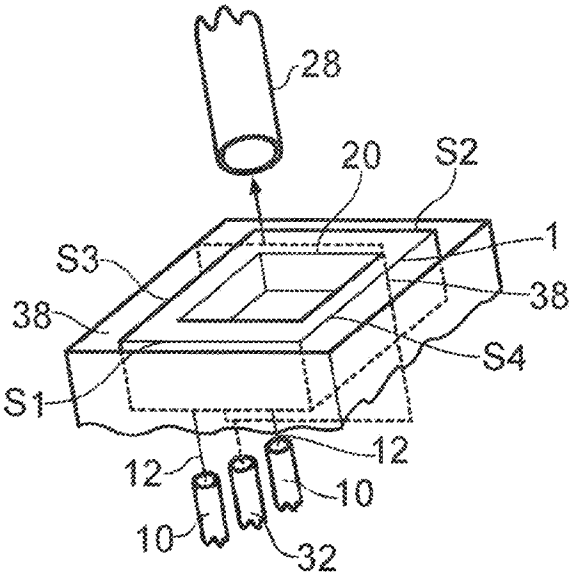
FIG. 2B shows a perspective view of portions of the cartridge shown in FIG. 2A, in accordance with certain embodiments of the disclosure.
Figure 2A:
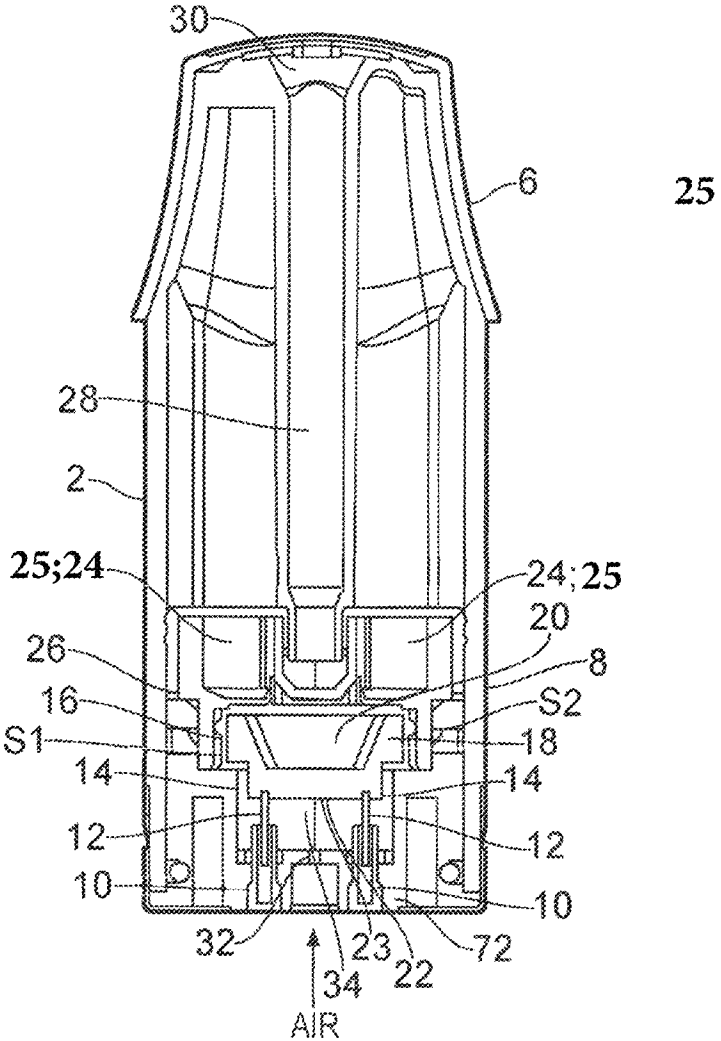
FIG. 2A schematically represents a cross sectional view of a cartridge, for use with the control unit from FIG. 1, in accordance with certain embodiments of the disclosure.

FIG. 2A schematically represents a cross sectional view of a cartridge, for use with the control unit from FIG. 1, in accordance with certain embodiments of the disclosure. In general terms, the cartridge comprises the electrodes 10, wherein each electrode 10 comprises an associated lead 12 which is operable to transfer power between the electrode 10 and a heating element 14. The cartridge 2 may further comprise a porous member 16 for use in holding a fluid to be atomised using the heating element 14. As shown in FIG. 2A, the porous member 16 may comprise a recess 18 defining a basin 20 for holding the fluid. In some embodiments, the porous member 16 may be a ceramic material, and may comprise silicone.

Figure 3:
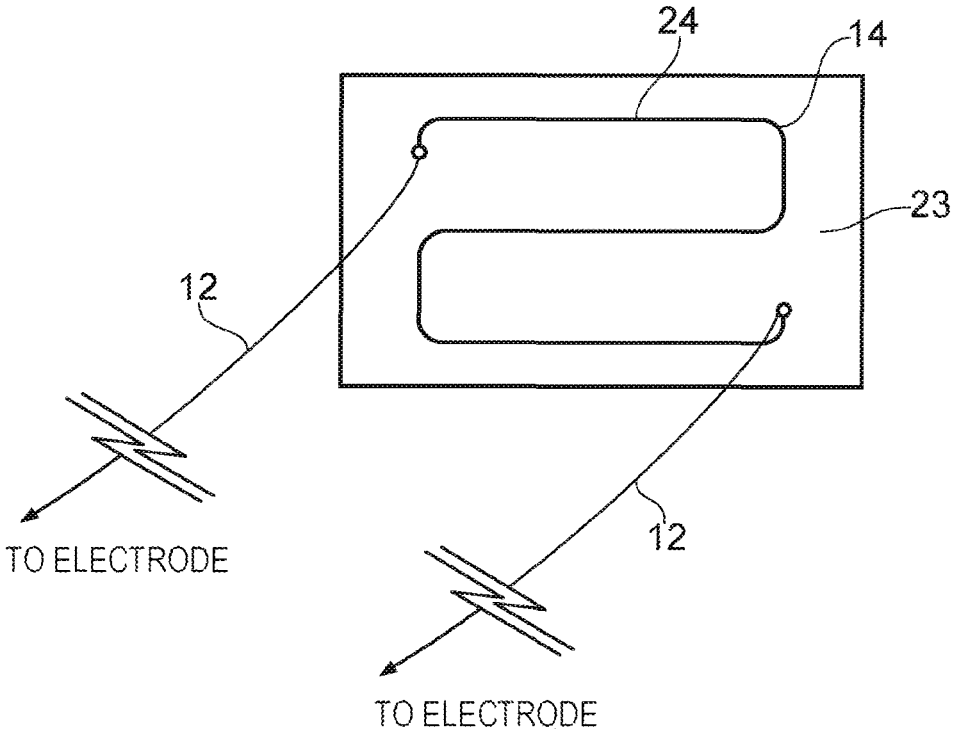
FIG. 3 schematically shows a heating element, located on a surface of a porous member, for use in the cartridge shown in FIG. 2A in accordance with certain embodiments of the disclosure.

In the embodiment shown in FIG. 2A, the heating element 14 is located between the basin 20 and each electrode 10. In terms of the structure of the heating element 14, in some embodiments the heating element 14 may be located on a surface 22 of the porous member 16. In the case of the embodiments shown in FIGS. 2A and 3, the surface 22 is located on an opposite side of the porous member to that of the basin 20.

To improve the transfer of heat from the heating element to the porous member 16, in some embodiments the heating element 14 may comprise a metal wire, which may form a tortuous path 23 on the surface 22 of the porous member 16. In that arrangement, a first end of the heating element may be connected to one of the two leads 12, and a second end opposite the first end of the heating element connected to the other of the two leads 12.

Located towards the mouthpiece end 6 of the cartridge is a chamber 25 acting as a primary reservoir 24 for storing fluid to be aerosolized. The chamber 25 is connected to the basin 20 via at least one opening 26 for topping up the level of fluid in the basin 20, which acts a secondary reservoir.

Extending through the centre of the chamber 25 is an outlet channel 28 for receiving aerosol generated from fluid emanating from the porous member 16. The outlet channel 28 extends from the porous member up towards a mouthpiece 30 located at the mouthpiece end 6 of the cartridge, for allowing a user to inhale the aerosol which is generated.

The cartridge comprises an air channel 32 extending through the cartridge for delivering air to the heating element 14. In the embodiment shown in FIG. 2A, the air channel 32 is located between the electrodes 10. Upon connection of the cartridge 2 with the control unit 4, the electronic cigarette 1 would be provided with a further air channel located in the cartridge 2 or the control unit 4 which is in fluid communication with the air channel 32, and which is configured to allow ambient air to be passed therethrough and into air channel 32.

The heating element 14 is located in an aerosol generation region 34 from the cartridge 2, and the outlet channel 28 and the air channel 32 are connected to the aerosol generation region 34.

In normal use, the cartridge 2 is coupled to the control unit 4 and the control unit activated to supply power to the cartridge 2 via the electrodes 10;11. Power then passes through the connection leads 12 to the heating element 14.

The function of the porous member 16 is to act as a capillary wick for drawing fluid from the basin 20 to the heating element 14. Accordingly, fluid which is wicked towards the heating element 14 through the porous member 16 is vaporised by the heat generated from the heating element 14. The generated vapor emanates from the surface 22 where it mixes with the air from the air channel 32 in the aerosol generation region 34 to form an aerosol. Fluid which is vaporised from the porous member 16 is replaced by more fluid drawn from the chamber 25 via the at least one opening 26.

Air enters the air channel 32 as a result of the user inhaling on the mouthpiece 30 of the cartridge 2. This inhalation causes air to be drawn through whichever further air channel aligns with the air channel 32 of the cartridge. The incoming air mixes with aerosol generated from the heating element 14 to form a condensation aerosol at the underside of the porous member 16 in the aerosol generation region 34. The formed aerosol then passes from the underside of the porous member 16, past a gap 38 located on two sides S3;S4 of the porous member as shown in FIG. 2B (the sides S3;S4 being perpendicular to the sides S1;S2 shown in FIG. 2A), and then up through the outlet channel 28 to the mouthpiece 30.

The above therefore describes a cartridge 2 for an aerosol provision system, wherein the cartridge 2 comprises a heating element 14 located in an aerosol generation region 34 from the cartridge 2, and is for heating fluid from a reservoir 20;24 to generate aerosol in the aerosol generation region 34, wherein the cartridge 2 further comprises an air channel 32 extending through the cartridge 2 for delivering air to the heating element 14.

Figure 4A:
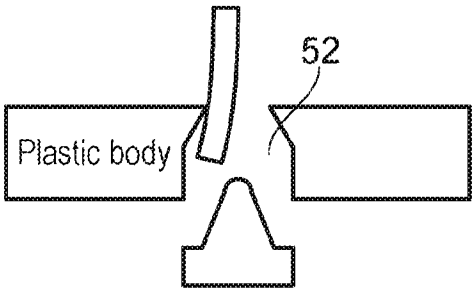
FIGS. 4A to 4D schematically represent various cross-sectional views collectively showing a method for securing a lead to an electrode inside an aperture of a body to generate an assembly, wherein the assembly is suited for use in the cartridge shown in FIG. 2A in accordance with certain embodiments of the disclosure.
Figure 4B:
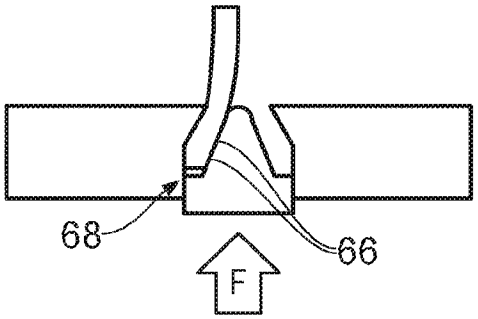
Figure 4C:
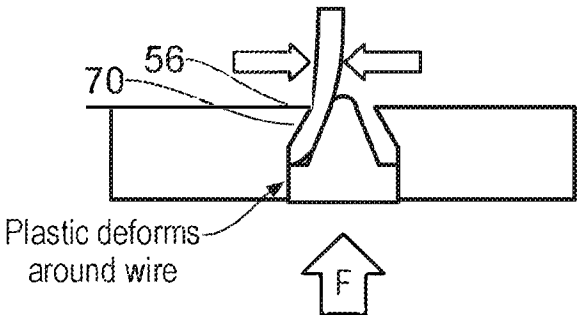
Figure 4D:
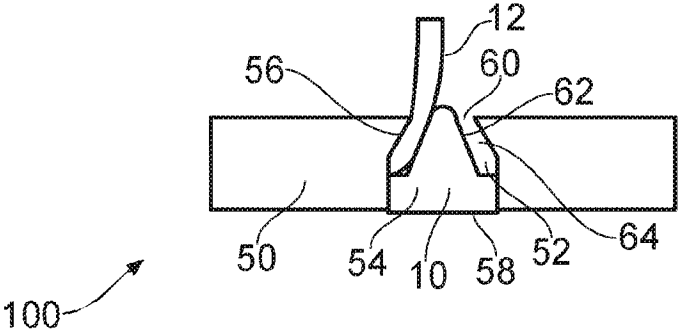

In terms of locating the electrodes 10 in the cartridge 2, in some embodiments, an assembly 100 as shown in FIG. 4D may be used. In such an assembly 100, there is a body 50 (which may be plastic) defining an aperture 52, and an electrode 10 comprising a portion 54 within the aperture 52. The assembly 100 further comprises a lead 12 comprising a section 56 which is secured inside the aperture 52 by a first interference fit between the body 50 and the portion 54 of the electrode 10. In some embodiments, the body 50 may be made of a plastic material, wherein the first interference fit is created by the body 50 being deformed into engagement with the section 56 of the lead 12. In some embodiments, the body 50 may be deformed through application of heat into engagement with the section 56 of the lead 12, as will be described in due course.

The aperture 52 shown in the embodiment of FIG. 4D comprises a first open end 58 and a second open end 60, wherein the electrode 10 extends through the first open end 58, and the lead 12 extends through the second open end 60.

In some embodiments, the portion of the electrode may comprise a tapered section 62 against which the section 56 of the lead 12 is secured. In that way, as shown in FIG. 4D, an annular recess 64 may be formed in the aperture 52 between the body 50 and the electrode 10, wherein the section 56 of the lead 12 is located within the annular recess 64.

The assembly 100 is formed with reference to the method shown in FIGS. 4A-4D. Starting with FIG. 4A, the electrode 10; the lead 12; and body 50 are initially separate to each other. From the separated position, the method comprises inserting the section 56 of the lead 12 into the aperture (as shown in FIG. 4A); and inserting the portion 54 of the electrode 10 into the aperture 52, such to secure the section of the lead 12 inside the aperture between the body 50 and the portion 54 of the electrode 10 by a first interference fit 66 (as shown in FIG. 4B). By virtue of the first interference fit 66, the lead 12 can be attached to the electrode 10 without the need for any crimping of the electrode around the lead 12. Since no crimping is required, this reduces the number of imperfections/defects created on the outer surface of each electrode 10—which might otherwise act as sites of mechanical weakness.

In some embodiments, to further secure the lead 12 inside the aperture 52, heat may be applied to deform a portion 70 of the body 50 into engagement with the section 56 of the lead 12, as shown in FIG. 4C. The heat may be applied either during, or for a period of time after, the insertion of the portion 54 of the electrode 10 into the aperture 52. In some embodiments, the heat may be conveniently applied through the lead 12, which then transmits the heat to the portion 70 of the body 50. As a result of the deformation of the portion 70 of the body 50, this deformation can be used to allow the body 50 to occupy any spaces/void left between the body 50 and the section 56 of the lead 12 in the vicinity of the first interference fit 66.

To further secure the electrode 10 with respect to the aperture 52, in some embodiments the electrode 10 may plug the first end 58 of the aperture 52 by a second interference fit 68 between the body 50 and the portion 54 of the electrode 10. The second interference fit also serves to reduce the permeability of fluid passing into or through the aperture 52.

The assembly 100, and the methods described for creating this assembly 100, is particularly suited for use in the cartridge 2. There, the body 50 from the assembly 100 may comprise a portion 72 of the cartridge 2 in which the electrodes 10 are located (e.g., a portion of the cartridge 2 which is located at the interface end 8). The portion 72 of the cartridge 2 may be integrally formed with the rest of the cartridge 2, or may be a plug member which is attachable to the rest of the cartridge 2.

By using the assembly 100 in the cartridge 2, such to have each lead 12 from the cartridge 2 comprising a section 56 which is secured inside a respective aperture 52 of the body 50 by a first interference fit 66 between the body 50 and the portion of the electrode 10 to which the lead is in contact with, this provides a cartridge 2 whereby the electrodes 10 are held securely without the need for any crimping of the electrodes 10. By avoiding the need for such crimping, the extent of imperfections/defects created on the outer surface of each electrode 10 may be reduced. Furthermore, with the provision of the first or the second interference fit, the extent of fluid passing from the aerosol generation region 34 through each aperture 52 past the electrodes 10 may be reduced, such to reduce the extent of leakage of fluid out from the cartridge 2.

Accordingly, there has been described an assembly comprising a body defining an aperture, and an electrode comprising a portion within the aperture, the assembly further comprising a lead comprising a section which is secured inside the aperture by a first interference fit between the body and the portion of the electrode.

There has also been described a cartridge for an aerosol provision system, wherein the cartridge comprises the assembly as described above, wherein the heating element is located in an aerosol generation region from the cartridge, and is for heating fluid from a reservoir to generate aerosol in the aerosol generation region, wherein the cartridge further comprises an air channel extending through the cartridge for delivering air to the heating element.

Also described is a method of connecting a body defining an aperture; an electrode; and a lead comprising a section which is configured to be secured inside the aperture, wherein the method comprises:

inserting the section of the lead into the aperture; and inserting the portion of the electrode into the aperture such to secure the section of the lead inside the aperture between the body and the portion of the electrode by a first interference fit.

There has also been described an assembly/cartridge as described above, wherein the section of the lead is secured inside the aperture using the methods described herein.

While the above described embodiments have in some respects focussed on some specific examples of an assembly comprising an interference fit between a portion of an electrode and a section of a lead, it will be appreciated the same principles can be applied for securing any two first and second components inside an aperture. That is to say, the specific manner in which the assembly is applied need not necessarily be restricted for use in a cartridge of an aerosol provision system.

In order to address various issues and advance the art, this disclosure shows by way of illustration various embodiments. The advantages and features of the disclosure are of a representative sample of embodiments only, and are not exhaustive or exclusive. They are presented only to assist in understanding and to teach the disclosed embodiments. It is to be understood that advantages, embodiments, examples, functions, features, structures, or other aspects of the disclosure are not to be considered limitations on the disclosure as defined by the claims or limitations on equivalents to the claims, and that other embodiments may be utilised and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other embodiments not presently claimed, but which may be claimed in future.

For instance, although the present disclosure has been described with reference to a "liquid" or "fluid" in the cartridge/aerosol provision system, it will be appreciated that this liquid or fluid may be replaced with any aerosolizable material. Equally, where an aerosolizable material is used, it will be appreciated that in some embodiments this aerosolizable material may comprise a liquid or fluid.

Furthermore, whilst the present disclosure has been described with reference to a heater/heating element being present in the cartridge/aerosol provision system, it will be appreciated that in accordance with some embodiments this heating element may be replaced with a vaporiser or some other aerosol generating component. Equally, such an aerosol generating component in accordance with some embodiments may in particular comprise a heater or heating element.

The invention claimed is:

1. An assembly configured for an aerosol provision system, the assembly comprising a body defining an aperture, and an electrode comprising a portion within the aperture, the assembly further comprising a lead comprising a section which is secured inside the aperture, and between the body and the portion of the electrode, by a first interference fit between the body and the portion of the electrode;

wherein the aperture comprises a first open end and a second open end, wherein the electrode extends through the first open end, and the lead extends through the second open end; and wherein the electrode plugs the first open end by a second interference fit between the body and the portion of the electrode, which prevents the lead from extending out of the aperture through the first end of the aperture.

2. The assembly according to claim 1, wherein the body is made of a plastic material, wherein the first interference fit is created by the body being deformed into engagement with the section of the lead.

3. The assembly according to claim 2, wherein the body is deformed through application of heat into engagement with the section of the lead.

4. The assembly according to claim 1, wherein the portion of the electrode comprises a tapered section against which the section of the lead is secured.

5. The assembly according to claim 1, further comprising an annular recess formed in the aperture between the body and the electrode, wherein the section of the lead is located within the annular recess.

6. The assembly according to claim 1, further comprising a heating element connected to the lead, wherein the lead is operable to transfer power between the electrode and the heating element.

7. The assembly according to claim 6, the assembly further comprising a porous member for use in holding aerosolizable material to be atomized using the heating element.

8. The assembly according to claim 7, wherein the porous member is a ceramic material.

9. The assembly according to claim 7, wherein the porous member comprises silicone.

10. The assembly according to claim 7, wherein the porous member comprises a recess defining a basin for holding the aerosolizable material.

11. The assembly according to claim 10, wherein the heating element is located between the basin and the electrode.

12. The assembly according to claim 7, wherein the heating element is located on a surface of the porous member.

13. The assembly according to claim 7, wherein the heating element comprises a metal wire forming a tortuous path on a surface of the porous member.

14. A cartridge for an aerosol provision system, wherein the cartridge comprises the assembly according to claim 6, wherein the heating element is located in an aerosol generation region from the cartridge, and is configured to heat aerosolizable material from a reservoir to generate aerosol in the aerosol generation region, wherein the cartridge further comprises an air channel extending through the cartridge for delivering air to the heating element.

15. The assembly according to claim 1, wherein the electrode at least partially extends out of the aperture through the second open end of the aperture.

16. A method of connecting an assembly for a vapor provision system comprising a body defining an aperture; an electrode; and a lead comprising a section configured to be secured inside the aperture, wherein the aperture comprises a first open end and a second open end, and wherein the method comprises:

inserting the section of the lead into the aperture such that the lead extends through the second open end; and inserting the portion of the electrode into the aperture such that the electrode extends through the first open end to secure the section of the lead inside the aperture between the body and the portion of the electrode by a first interference fit, and such that the electrode plugs the first open end, by a second interference fit between the body and the portion of the electrode, which prevents the lead from extending out of the aperture through the first open end of the aperture.

17. The method according to claim 16, wherein the method further comprises:

applying heat to deform a portion of the body into engagement with the section of the lead.

18. The method according to claim 17, wherein the heat is applied through the lead.

19. The assembly according to claim 1, wherein the section of the lead is secured inside the aperture by inserting the section of the lead into the aperture; and inserting the portion of the electrode into the aperture such to secure the section of the lead inside the aperture between the body and the portion of the electrode by the first interference fit.

* * * * *